United States Patent [19]

Smolensky

[11] Patent Number: 4,474,589

[45] Date of Patent: Oct. 2, 1984

[54] STEAM-WATER SEPARATOR

[75] Inventor: Leo A. Smolensky, West Hartford, Conn.

[73] Assignee: Combustion Engineering, Inc., Windsor, Conn.

[21] Appl. No.: 483,393

[22] Filed: Apr. 8, 1983

[51] Int. Cl.[3] ..... B01D 57/00

[52] U.S. Cl. ..... 55/337; 55/347; 55/399

[58] Field of Search ..... 55/52, 199, 203, 337, 55/345–347, 399, 401, 406–408

[56] References Cited

U.S. PATENT DOCUMENTS

| | | | |
|---|---|---|---|
| 2,418,184 | 4/1947 | McConaghy | 55/203 |
| 3,314,220 | 4/1967 | Goldstein | 55/347 X |
| 4,162,150 | 7/1979 | Carson | 55/337 |

FOREIGN PATENT DOCUMENTS

| | | | |
|---|---|---|---|
| 592823 | 2/1960 | Canada | 55/346 |
| 56-2807 | 1/1981 | Japan | 55/52 |

*Primary Examiner*—Charles Hart

*Attorney, Agent, or Firm*—Arthur L. Wade

[57] ABSTRACT

Steam-water separators are comprised of a single vertical shell mounted over a hole in a horizontal deck within a steam drum. Vanes within the cylinder imparts centrifugal force to the upwardly flowing mixture of saturated steam and water. The saturated water is thrown to the internal wall of the shell and skimmed over the upper edge of the shell to descend in flowing over the upper surface of a series of downwardly spiraling trays while evolved steam disengages from the saturated water.

2 Claims, 3 Drawing Figures

STEAM-WATER SEPARATOR

TECHNICAL FIELD

The present invention relates to the secondary separation of steam and saturated water in a separator mounted in the upper drum of a steam generator. More particularly, the invention relates to decreasing the travel of entrained steam to the surface of saturated water primarily vortexed in a steam separator.

BACKGROUND ART

The steam-water separators mounted on a horizontal deck within the upper steam drum of a generator have a well-known structure. The drum functions as a header for the multiple tubes of the evaporative circuit including the waterwall of the furnace, receiving from the tubes a mixture of saturated water and steam as the mixture flows upward from its heat absorption in the evaporative circuit. A fundamental requirement is to separate this mixture into its relatively dry steam and its unvaporized water. Separated, dry steam is drawn to usage, generally in a turbine, while the saturated water is recirculated to absorb additional furnace heat in the tubes of the waterwalls. Thus, the steam drum forms an important fork in the road over which flows the mixture of steam and saturated water. At this juncture in the road/path, static separation structure is mounted to receive the mixture and positively separate it into its components.

In advancement of this separation art, little notice is given to the source of heat vaporizing some portion of the feedwater. The source of heat may be by nuclear fission, the combustion of pulverized solid fuel, oil or gas combustion, etc. All these fuel sources produce heat absorbed by feedwater in tubes which route partially vaporized feedwater up to the steam drum. Separated, the saturated water forms a lower body in the horizontally extended drum which interfaces with steam collected in the upper region of the same drum. A horizontal plate or deck is mounted within the drum as a support for the steam-water separators and holes through this deck form passages for the upwardly-flowing steam and water mixture. The steam is drawn from the drum with a conduit connected through the upper wall, while the feedwater is drawn through conduits connected through the lower wall of the drum. The separator structures are mounted over the holes through the horizontal deck where they work their technological magic in wringing out the steam from saturated water. The saturated water constantly flows downward from the structure, while the steam separated therefrom flows upward.

The primary separation of the steam from the saturated water takes place within the cylindrical, open-ended shells vertically mounted over the holes of the horizontal deck. The upwardly-flowing steam-water mixture is spun toward the walls of the shells, causing a primary separation as the heavier water flows horizontally outward from the spinning mixture, leaving the lighter steam to travel up the center of the whirling mass. Of course, the primary separation is far from ideal and secondary separation is carried out on both the steam entraining finer bodies of liquid and on the saturated water containing residual droplets of steam.

Additional spinning of the primarily separated saturated water has been carried out as disclosed in at least Carson U.S. Pat. No. 4,162,150. In this disclosure the primarily separated saturated water flowed downwardly in the annulus between two cylindrical shells has been given a second spinning with an object to releasing remnant steam. If this saturated water skimmed from primary separation can be alternatively flowed over a surface to form thin sheets, the bubbles of steam entrained in the saturated water can be provided shortened paths to the freedom of separation.

DISCLOSURE OF THE INVENTION

The present invention contemplates providing an elongated path for the primarily separated saturated water in a steam drum separator. The primarily separated saturated water skimmed from the internal wall of the cylinder is directed down the elongated path on which the saturated water is spread in a thin sheet to provide short lengths of travel for entrained steam bubbles to reach the surface of the saturated water in secondary separation.

The invention further contemplates spiral trays mounted on the outside of a single separator cylinder to receive saturated water skimmed from the inner wall of the cylinder to provide an elongated path for the relatively thin sheet of saturated water in secondary separation of steam droplets entrained by the water.

Other objects, advantages, and features of the invention will become apparent to one skilled in the art upon consideration of the written specification, appended claims and accompanying drawings.

BRIEF DESIGNATION OF THE DRAWINGS

BEST MODE FOR CARRYING OUT THE INVENTION

Terms and Technology

Figure 1:
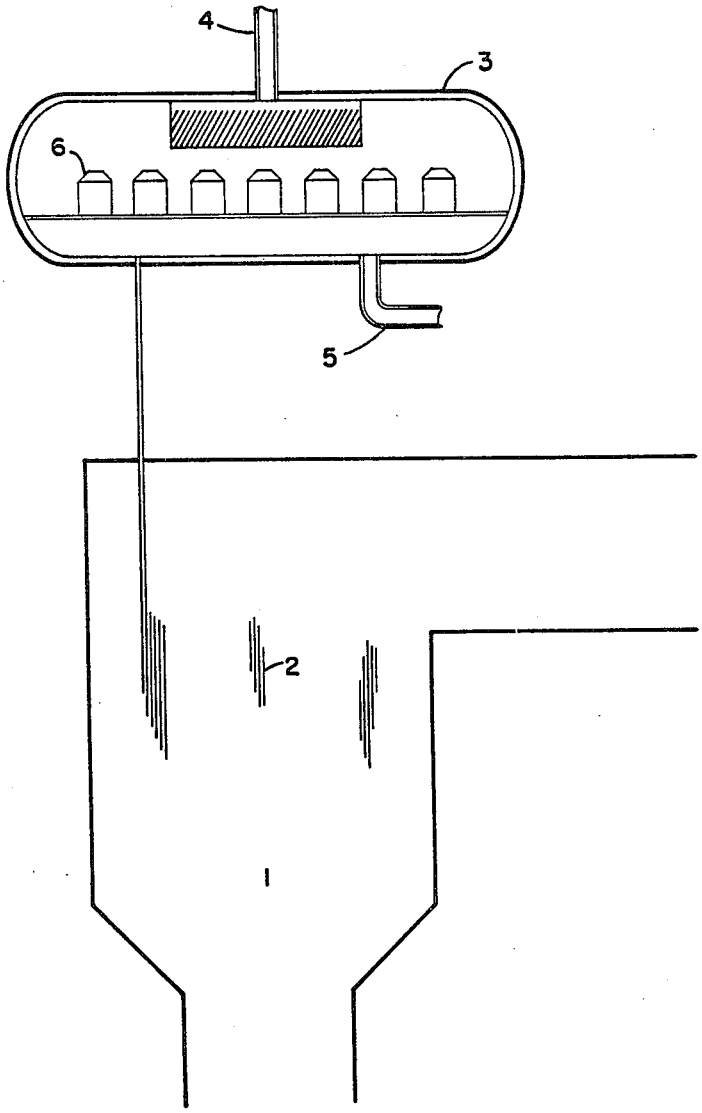
FIG. 1 is a partially sectioned elevation of the part of a utility boiler including the steam drum in which are mounted, separators embodying the present invention.

Although the present invention is disclosed in structure mounted in the steam drum of the conventional utility boiler, the usefulness of the invention is by no means restricted to use in the sepcific boiler illustrated in the drawings. The present invention is embodied in secondary separation structure mounted on the outside of a single, vertically extended cylinder comprising the housing of a steam separator. This housing receives an upwardly-flowing mixture of saturated steam and saturated water into the lower end of the cylinder for primary separation. Following the primary separation, the saturated water is skimmed on to the embodiment of the present invention which provides a lengthy travel during which the water is flowed in a thin sheet as an act of secondary separation of the water and any steam entrained therein.

The housing of the separator is mounted on a horizontal deck, plate, sheet, or baffle, for support of the separator. The housing of the separator is mounted over a hole in this support structure and the mixture to be separated is flowed up through the hole and into the housing. The mixture is spun by a vane arrangement in the cylindrical separator housing. Saturated water spun to the internal wall of the cylinder travels up that wall and is skimmed over the top and controlled to discharge onto trays in which the present invention is embodied.

Within the framework of the foregoing terms and their relationship to the structure defined within the technology, the form and function of the embodiment of the invention should be readily understood.

Environment Of The Separator

FIG. 1 serves to locate the steam drum separator within the matrix of equipment comprising the boiler, or steam generator. Disclosing the generator to be a utility boiler, the combustion chamber 1 is indicated as defined by layers of tubes which can be referred to as the waterwalls 2 of the combustion chamber. A source of feedwater, not necessarily shown, is conventionally connected to the tubes which combine to form the waterwalls 2, and the feedwater flows upward through the waterwall tubes as the heat generated in the combustion chamber 1 is absorbed through the tube walls. Of course, the fundamental objective of this arrangement is to convert the feedwater into steam by elevating its temperature.

The tubes may be interconnected in various arrangements, including manifolds into which the fluids of the tubes are collected. In all events, the rising mixture of water and steam reaches steam drum 3. This steam drum is disclosed in the form of a huge cylinder whose axis is horizontally extended. The conducting tubes deliver a mixture of saturated steam and saturated water to drum 3, while a conduit 4 through the upper wall of the drum removes steam for use in driving a turbine. That portion of the water not converted to steam is removed through at least one conduit 5 through the lower wall of the drum to be recycled back into the system for subsequent conversion into steam. The present disclosure is primarily concerned with these elements of the utility boiler needed to highlight the position and function of steam-water separators within drum 3.

The steam-water separators 6 are mounted within drum 3 to function as structure to divide steam from the water with which it is mixed. The present invention is concerned with the separation of the saturated steam and saturated water which is routed as a mixture to the housings of separators 6. The object is to "dry" the steam, i.e. remove as much water as technologically possible before the steam is passed to the turbine through conduit 4. To perform this separation, the mixture of saturated steam and saturated water is first subjected to centrifugal force which mechanically forces the heavier water radially toward the inside wall of the cylindrical housing. Both the water and steam move upward within the housing, the heavier water centrifuged to the housing surface, moving upward over that surface while the steam moves upward close to the axis of the housing. This is the first, or primary, separation performed on the mixture.

The primary separation is not carried out with ideal efficiency. The saturated steam entrains remnants of saturated water in the form of droplets. The saturated water contains remnants of saturated steam in the form of droplets. A secondary separation is carried out on the centrifuged water to "wring out" whatever remnants of steam it contains after primary separation. This secondary separation is carried out on that saturated water skimmed over the top of the separator housing.

Separator Mounted Within The Steam Drum

Figure 2:
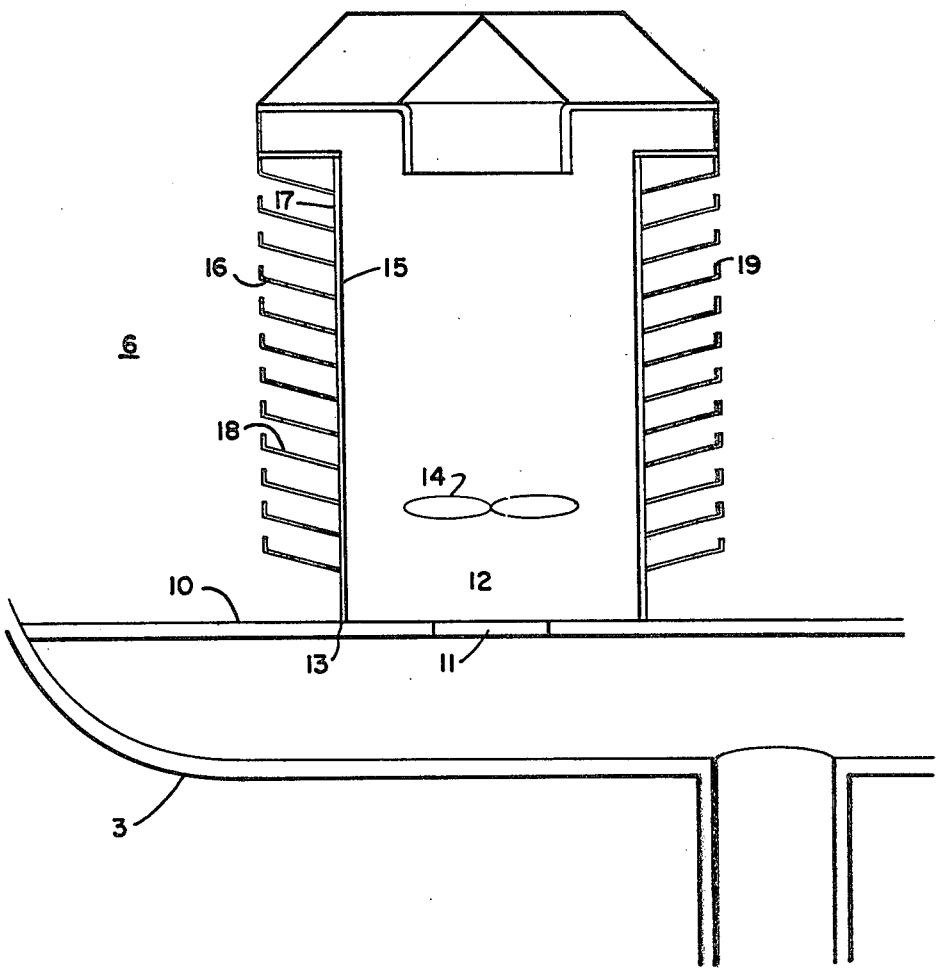
FIG. 2 is a sectioned elevation of a single separator of FIG. 1, disclosing areas of primary and secondary separation.

FIG. 2 is established to more precisely orient the separator as mounted within steam drum 3. A deck 10 is mounted horizontally within drum 3 and baffling brings the mixture of saturated steam and saturated water beneath the deck 10 so the mixture will be forced up through a plurality of holes 11 in the deck. Steam separator housings 6 are mounted on top of the deck 10, a separator 6 over each hole 11 to receive the mixture up through the lower entrance 12 of the cylindrical housing 13. As the mixture flows up into the lower end of cylindrical housing 13 it is forced into a spin by contact with the configuration of vanes 14 mounted within the housing 13. The spin generates the centrifugal force of primary separation on the mixture and the water, forced radially to the inner wall surface 15, continues its upward travel on the surface 15 to the top of housing 13. Once flowed over the top edge of the housing cylinder 13, the saturated water, with entrained steam, is given a secondary separation on structure embodying the present invention.

The secondary separation is provided by directing the skimmed saturated water onto the surface of a series of trays 16 mounted on the external wall 17 of cylindrical housing 13. Descending along the upper surfaces 18 of trays 16, the saturated water is spread in a thin sheet for a finite length of time. Thus, is provided a shortened distance for the entrained bubbles of steam to reach the surface of the saturated water and disengage therefrom.

Figure 3:
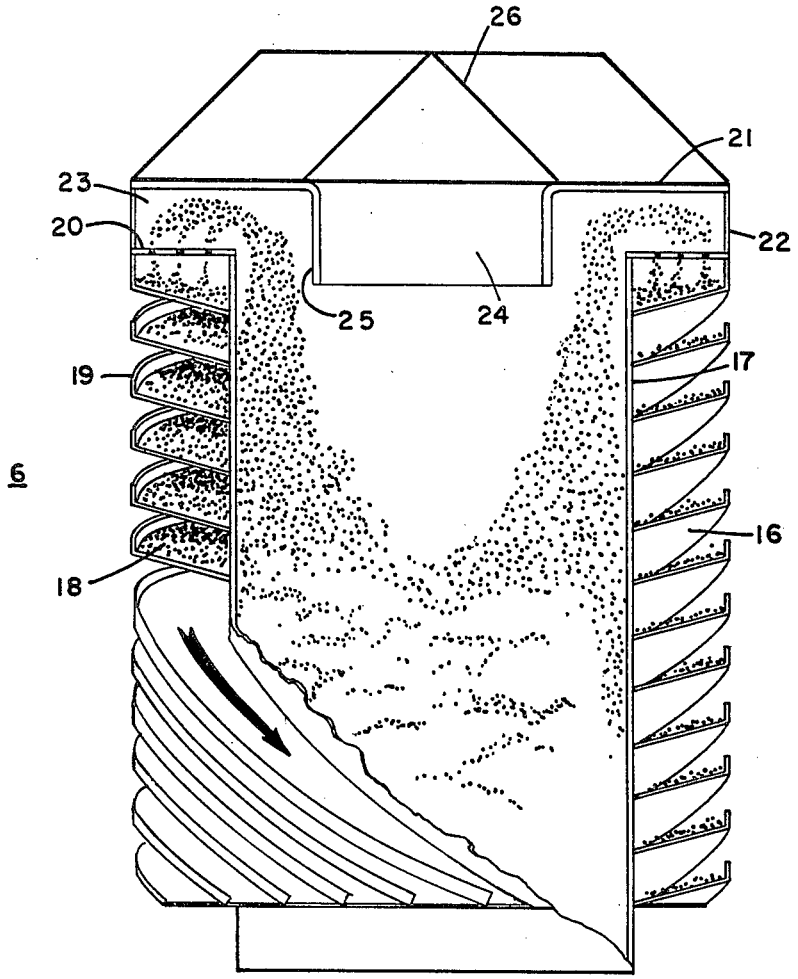
FIG. 3 is a sectioned elevation in which greater details of the spiral trays of the separator are disclosed.

Taking the disclosures of FIGS. 2 and 3 together, the trays 16 are disclosed as mounted by their inner edges to the external wall 17 of cylinder housing 13. More specifically, the trays 16 are spiraled downward along this wall, preferably at a pitch which will give roughly 1½turns along the vertical length of the cylinder housing 13. It is estimated that the number of these trays required, spiraling in parallel down along the outside of housing 13, will range from perhaps 15 to 30; however, the specific number of trays, their lengths and widths, is a matter of design under the concepts of the invention.

Retention of the water on the upper surface 18 of these trays is provided by an upturned lip 19 on each tray. Again, the height of this lip 19 on each tray to establish the depth of the saturated water flowing on the surface of the tray, is a matter of design. The ultimate objective of the arrangement is to provide the distance the saturated water will flow and the depth of the layer with which the water flows to provide significant disengagement of the entrained steam from the water. The disengaged steam will rise from this secondary separation to join the primarily separated steam directed upward close to the axis of housing 13. All the steam collects in the upper portion of the steam drum and is drawn therefrom to provide turbine power.

With these trays 16 mounted by their one edge to the external surface of housing 13, they extend from a position near the top of the housing at which they receive the skimmed water as it passes over the upper edge of the housing. Specifically, a perforated plate 20 extends radially from the top of the housing. This plate 20 preferably extends approximately the width of the lower trays 16. Cap plate 21 extends horizontally a finite distance above perforated plate 20, supported by a downward lip extension 22. In other words, lip 22 joins the outer periphery of perforated plate 20 and cap plate 21. Chamber 23 is formed by this arrangement of plates 20, 21, and lip 22. It is into this chamber 23 that the water is skimmed from the top of housing 13 to be distributed through the perforations of plate 20 and onto the trays 16 below.

Cap plate 21 has a central aperture 24, a depending lip 25 from this aperture forms a passageway axially aligned with housing 13. It is up through this passageway formed by lip 24 that the steam from primary separation passes to the upper region of the steam drum. A screen structure 26 is supported over the passageway upon which entrained droplets of saturated water may be coalesced from the primarily separated steam in secondary separation. The coalesced water on the screen is expected to travel down and flow outwardly on the cap plate 21 to fall from the outer edge thereof to the lower region of the steam drum.

Epilogue

There may be some virtue in restating what has now become obvious as the structural arrangement embodying the invention. The prior art has consistently disclosed a two-cylinder combination of a steam-water separator mounted on decks within steam drums. Vortexing a mixture of steam and water to be separated within the inner of these concentric cylinders has developed centrifugal force on the liquid as an act of primary separation. Forced to the wall of the inner cylinder and upward to its end, the water has been skimmed into the annulus formed between the two concentric cylinders of the separator housing. Various structural arrangements within this annulus have been provided to function as secondary separation of the saturated water and entrained steam. Fundamentally, under the concepts of the present invention, the outer of the concentric cylinders has been stripped away and replaced by a tray structure on whose surface the saturated water flows. The tray structure is arranged uniformly about the opening of the vertical cylindrical housing to receive the skimmed saturated water and entrained steam. The tray structure is comprised of a series of spirally arranged surfaces extending radially from the external surface of the housing. Retained by an outer lip on each tray, the saturated water is flowed in a descending shallow stream to provide an extremely short path for the entrained steam bubbles to reach the surface of the saturated water. Ready disengagement of the two fluids takes place as the secondary separation formerly carried out within the annulus of the concentric cylinders of the prior art separator.

All the additional support structure for the spiral tray structure is adjunct to this embodiment of the invention. The cap structure collects, guides and distributes the skimmed saturated water to the upper end of the trays. The raison d'etre of the invention resides in the tray structure, itself, which eliminates the need for the outer concentric housing cylinder of the prior art. By the time the saturated water has reached the downward end of its travel, a significant quantity of the saturated steam entrained therein has been disengaged to travel upwardly within the steam drum and join that steam from the primary separation.

From the foregoing, it will be seen that this invention is one well adapted to attain all of the ends and objects hereinabove set forth, together with other advantages which are obvious and inherent to the apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawings is to be interpreted in an illustrative and not in a limiting sense.

I claim:

1. A saturated steam-water separator adapted to be mounted over an aperture in a horizontally extended deck within the steam drum of a utility boiler, including, a housing shell having the configuration of a vertically oriented open-ended cylinder mounted over the deck opening, vane structure within the shell arranged to impart centrifugal motion to a mixture of saturated steam and water flowing upwardly through the housing, a cap plate horizontally extended over the upper end of the housing shell and spaced and baffled to form a chamber in which the saturated water centrifuged to the internal wall of the shell accumulates, an apertured plate extending horizontally from the upper end of the housing shell to distribute the saturated water about the external upper end of the housing shell, a series of trays externally mounted on the housing shell with their upper ends below the apertured plate to receive the distributed saturated water upon the trays in order for the saturated water to flow the length of the trays, and a lip on the outward edge of each tray to establish the depth at which the saturated water will flow the length of each tray while entrained saturated bubbles of steam disengage from the water.

2. The separator of claim 1, wherein, the trays are mounted to spiral downward on the external surface of the housing shell.

* * * * *